US005633800A

United States Patent [19]

Bankert et al.

[11] Patent Number: 5,633,800

[45] Date of Patent: May 27, 1997

[54] INTEGRATED MODEL-BASED REASONING/ EXPERT SYSTEM DIAGNOSIS FOR ROTATING MACHINERY

[75] Inventors: Raymond J. Bankert, Clifton Park; Imdad Imam, Schenectady; Harindra Rajiyah, Clifton Park, all of N.Y.

[73] Assignee: General Electric Company, Schenectady, N.Y.

[21] Appl. No.: 964,168

[22] Filed: Oct. 21, 1992

[51] Int. Cl.[6] ..... G07C 3/14

[52] U.S. Cl. ..... 364/474.194; 364/508; 364/578; 395/920; 73/527; 340/683

[58] Field of Search ..... 364/150, 151, 364/221.2, 274.4, 274.2, 276.3, 916.3, 507, 508–551.02, 474.19, 578; 73/579, 587–593, 660; 395/920; 340/679, 682, 683

[56] References Cited

U.S. PATENT DOCUMENTS

| | | | |
|---|---|---|---|
| 4,471,447 | 9/1984 | Williams et al. | 364/151 |
| 4,471,448 | 9/1984 | Williams | 364/151 |
| 4,563,746 | 1/1986 | Yoshida et al. | 364/551 |
| 4,783,998 | 11/1988 | Sander | 73/660 |
| 4,805,457 | 2/1989 | Oates et al. | 73/660 |
| 5,016,204 | 5/1991 | Simoudis et al. | 364/578 |
| 5,101,337 | 3/1992 | Ebizka | 364/184 |
| 5,187,773 | 2/1993 | Hamilton et al. | 364/551.02 |

*Primary Examiner*—Emanuel Todd Voeltz
*Assistant Examiner*—Craig Steven Miller
*Attorney, Agent, or Firm*—Marvin Snyder

[57] ABSTRACT

A diagnostic system and method for rotating machinery having mechanical problems combine AI-based interpretive reasoning with rotordynamic-based modeling and numerical optimization. A vibration response in the machinery to be diagnosed is first measured by machine sensors, and this measured response is used in a rule-based expert system to determine a probable cause of the machinery's mechanical problem. An appropriate finite element analytical model of the machinery is generated based on the probable cause. An optimizer computes the predicted response from the analytical model and compares it with the measured response. The model is automatically refined, guided by the expert system and numerical optimization, to match the predicted response with the measured response. The modifications to the model necessary to duplicate the measured response of the defective machinery are then indicative of the defects.

9 Claims, 2 Drawing Sheets

INTEGRATED MODEL-BASED REASONING/ EXPERT SYSTEM DIAGNOSIS FOR ROTATING MACHINERY

BACKGROUND OF THE INVENTION

This invention relates generally to diagnosing mechanical problems in rotating machinery such as gas or steam turbines and more particularly concerns a computer-aided diagnostic system and method which combine AI-based interpretive reasoning with rotordynamics-based modeling and numerical optimization.

Rotating machinery such as power generating equipment almost inevitably develops some mechanical problems over time. Almost all of these mechanical problems, such as unbalance or misalignment, produce a synchronous vibration signal. Vibrations in rotating machinery can ultimately lead to fatigue and even failure of components; thus, the smoother a piece of equipment runs, the longer and more trouble-free its life will be. Therefore, it is beneficial to take corrective measures soon after the appearance of such problems. Such maintenance is particularly important in the power generation industry because over fifty percent of the major power equipment currently in operation has been in service for 25 years or longer. Continued availability of power from these machines at a reasonable cost is one of the most important economic factors in power plant operation.

The most common corrective measure is to add counteracting balance weights which correct a mass unbalance. However, experience with gas and steam turbines has shown that mass unbalance is the problem only about 30 percent of the time. For the rest of the time, the addition of balance weights will produce only a temporary vibration reduction, or none at all. Furthermore, conventional balancing techniques can be very time consuming and require the unit to be taken off-line during the corrective procedure. Such shutdowns are very costly to power generation plant operators. Thus, there is much interest in quickly and accurately diagnosing mechanical problems in rotating systems such as steam-turbine generator units to reduce forced shutdowns and maintenance costs in power plants.

Most vibration diagnostic work is done by experienced troubleshooting engineers based on empirical knowledge. However, expert system technology which automates the empirical knowledge is finding applications in power plant troubleshooting and maintenance practices. Current diagnostic expert systems provide "probabilistic" and "qualitative" diagnoses with only a limited capability of differentiating between various mechanical problems such as mass unbalance, misalignment, rubbing and so forth. These expert systems have knowledgebases consisting of specific rules which capture currently available knowledge. The diagnostic rules are developed from both analytical modeling and past experience. These rules are thus limited to diagnosing problems which have been identified or modeled in the past. Thus, there is a need for a diagnostic system which is not limited to qualitative solutions based on probable causes. More specifically, there is a need for a system which not only determines the specific flaw or flaws causing the mechanical vibrations, but also determines the location and severity of the flaws.

SUMMARY OF THE INVENTION

The present invention fulfills the above-mentioned needs by providing a diagnostic system and method in which a vibration response in the machinery to be diagnosed is measured by sensors, and this measured response is used in an expert system to determine a probable cause of the machinery's mechanical problem. An appropriate finite element analytical model of the machinery is generated based on the probable cause. An optimizer computes the predicted response from the analytical model and compares it with the measured response. The model is repeatedly modified until the difference between the predicted and measured responses is minimized. The modifications to the model necessary to duplicate the measured response of the defective machinery are then indicative of the defects.

Other objects and advantages of the present invention will become apparent upon reading the following detailed description and the appended claims and upon reference to the accompanying drawings.

DESCRIPTION OF THE DRAWINGS

The subject matter which is regarded as the invention is particularly pointed out and distinctly claimed in the concluding portion of the specification. The invention, however, may be best understood by reference to the following description taken in conjunction with the accompanying drawing figures in which:

DETAILED DESCRIPTION OF THE INVENTION

Figure 1:
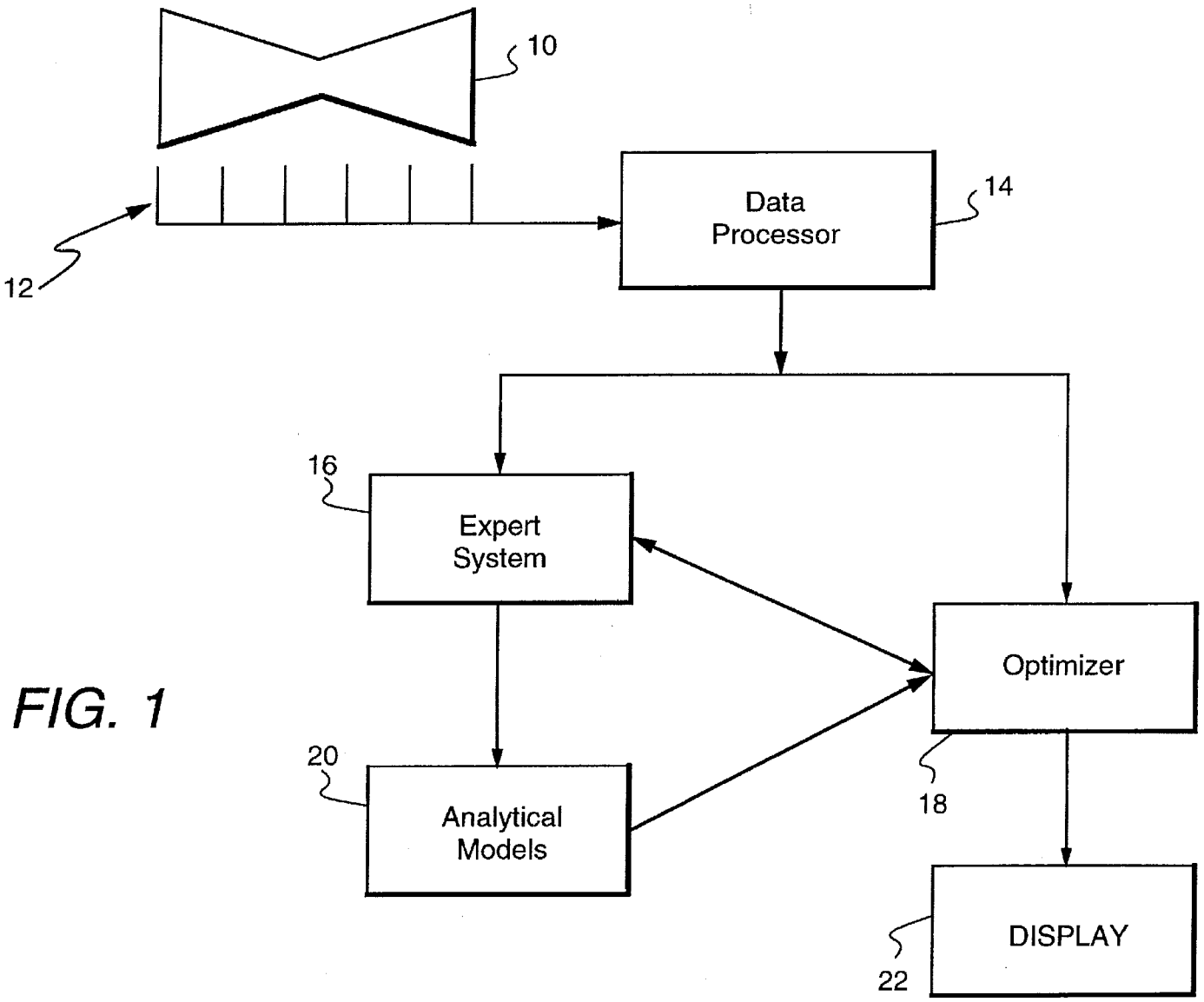
FIG. 1 is a schematic representation of the system of the present invention.

FIG. 1 shows a system architecture of the present invention. A rotating machine 10 having an unknown defect or mechanical problem to be diagnosed is shown schematically in the Figure. Although the present invention is applicable to all types of rotating machinery, the rotating machine 10 is most typically a multiple rotor device such as a steam-turbine generator unit found in a power generation plant. A plurality of sensors 12 are positioned adjacent to the rotating machine 10. The sensors 12 can be any of a variety of devices dependent on the particular diagnostic problem being addressed. For instance, the sensors 12 can comprise proximity probes or shaft riders for making shaft vibration measurements or accelerometers or velocity probes for making bearing cap vibration measurements. While vibration measurements are needed most often, the sensors 12 can also include temperature, speed or pressure sensors.

The output of the sensors 12 is fed to a data processor 14 which converts the sensor output into digitized data, referred to herein as the field data or measured response. A signal representative of the measured response is fed to an expert system 16 and an optimizer 18. The expert system 16 analyzes the measured response and accordingly develops a qualitative solution hypothesis. Specifically, the expert system 16 generates a hierarchy of probable causes of the mechanical problem based on the field data. For power generation machinery, such probable causes can include, but are not limited to, misalignment, mass unbalance, rubbing and cracking. The expert system 16 can be any such system known in the art. Preferably, the expert system 16 uses reasoning based upon a knowledgebase consisting of specific rules which capture currently available knowledge. For example, if the currently available knowledge held that a certain vibration signal was indicative of misalignment, then the rule-based expert system 16 would indicate misalignment as a probable cause of mechanical problems if that vibration signal was detected.

The highest probable cause hypothesis in the hierarchy generated by the expert system 16 is fed to the optimizer 18.

The optimizer 18 accordingly compares the measured response from the data processor 14 to a predicted response which is obtained from an analytical model selected from a library of analytical models 20. The analytical models 20 include a number of rotordynamic models of various rotating machines which contain the geometric, weight, inertia, bearing and pedestal properties of the individual machines. Which model is selected by the optimizer 18 depends on the probable cause identified by the expert system 16 and the class of machinery being diagnosed.

The optimizer 18 automatically changes the model parameters affecting the identified probable cause until the predicted response of the selected model and the measured response converge. When the measured and predicted responses reach a suitable convergence, the resulting modified model closely defines the current state of the defective rotating machine 10. Accordingly, by monitoring how the selected model was modified in order to define the defective rotating machine 10, the defects of the machine 10, and thus the solution to the diagnostic problem, can be specified. This solution is produced on a display 22 so that a field engineer can bring about the appropriate repairs.

In the case where the optimizer 18 cannot achieve a suitable convergence between the measured and predicted responses, the expert system 16 is called upon to identify the next most likely probable cause from the hierarchy. The model corresponding to the newly-identified probable cause is called up from the analytical models 20 and the optimization process described above is repeated. This is continued until a suitable convergence is achieved.

The analytical models 20 comprise a large number of codes modeling the various classes of rotating machinery which the system is designed to be used with. A different model is created for each class of rotating machine with each of the probable causes identifiable by the expert system 16. Thus, for example, if the expert system 16 was designed to identify four different probable causes, say mass unbalance, misalignment, rubbing, and cracking, then there would be four different models for each class of applicable machinery. To bring rotordynamic modeling into the AI environment, a complicated machine like a steam-turbine generator unit will need to be properly modeled. This can be facilitated by using finite-element based rotordynamics models. This approach creates a finite element model from detailed design drawings of the class of machinery being modeled. The finite element based rotordynamic code uses beam elements with four degrees of freedom at each node. A node is the vertex or point of intersection between elements. To model an entire turbine-generator unit typically requires b 200to 300 nodes. The code uses a consistent mass representation to lump the mass at the node points and then to reduce numerical complexities, a condensation technique creates selected master-degree-of-freedoms. The bearings are modeled with linear springs and viscous dampers and includes cross-coupling effects. The bearing pedestals are also modeled.

The optimizer 18 essentially quantifies the qualitative probable cause solution identified by the expert system 16. This is accomplished by using a numerical optimization technique to modify the selected model. The optimization technique which is traditionally used for design is, in the present invention, applied to diagnostics. The goal changes from being one of satisfying constraints to one of replicating the measured response in the analytical model. Generally, optimization involves defining and then minimizing an objective function. Minimization is accomplished by repeatedly varying one or more design variables through a number of iterative steps to converge on a solution. To reach a solution in a reasonable number of iterations, the design variables are not varied in a random fashion. Instead, it is more effective to identify an appropriate direction and magnitude of step for each iteration.

In the present invention, the design variable or variables altered for optimization are the parameters which affect the probable cause identified by the expert system 16. As mentioned above, an effective direction of step for the selected design variable must be identified to achieve acceptable turnaround times. This is done in the present invention by determining the gradient of the objective function with respect to the design variable because this gradient specifies the direction of steepest descent. Thus, the present invention requires computation of the gradient of the objective function as well as the predicted response of the selected model to perform the optimization process.

The optimizer 18 defines its objective function as the squares of the differences of the real and the imaginary parts of the measured and predicted responses. Thus, the objective function, obj, can be given as:

$$obj = \sum_{i=1}^{nodes} (u_i^{real} - u_i^{realfield})^2 + (u_i^{imag} - u_i^{imagfield})^2 \tag{1}$$

where $u_i^{real}$ and $u_i^{realfield}$ correspond to the real parts of the ith nodal displacements of the predicted and measured responses, respectively, and $u_i^{imag}$ and $u_i^{imagfield}$ respectively correspond to the imaginary parts of the ith nodal displacements of the predicted and measured responses. The gradient of the objective function, obj, with respect to the design variable, $a_j$, is:

$$\frac{\partial(obj)}{\partial a_j} = \sum_{i=1}^{nodes} 2(u_i^{real} - u_i^{realfield}) \frac{\partial u_i^{real}}{\partial a_j} + 2(u_i^{imag} - u_i^{imagfield}) \frac{\partial u_i^{imag}}{\partial a_j}. \tag{2}$$

The partial derivatives of equation (2) must be computed to solve the equation. This can be accomplished by defining the system parameters and associated modal information. The equation governing the finite element model of a rotating machine with defects in condensed form is:

$$\begin{bmatrix} \text{system} \\ \text{parameters} \end{bmatrix} \{\text{response}\} = \begin{Bmatrix} \text{forcing} \\ \text{function} \end{Bmatrix}. \tag{3}$$

The partial derivatives needed for equation (2) can now be computed by differentiating equation (3) such that:

$$\begin{Bmatrix} \frac{\partial u}{\partial a_j} \end{Bmatrix} = \frac{\begin{Bmatrix} \frac{\partial}{\partial a_j} \begin{Bmatrix} \text{forcing} \\ \text{function} \end{Bmatrix} - \begin{bmatrix} \frac{\partial}{\partial a_j} \begin{bmatrix} \text{system} \\ \text{parameters} \end{bmatrix} \end{bmatrix} \{\text{response}\} \end{Bmatrix}}{\begin{bmatrix} \text{system} \\ \text{parameters} \end{bmatrix}}. \tag{4}$$

To reduce computation time, the "system parameters" matrix of equation (3) can be recast as:

$$\begin{bmatrix} \text{system} \\ \text{parameters} \end{bmatrix} = \begin{bmatrix} \text{invariant} \\ \text{system parameters} \end{bmatrix} + \begin{bmatrix} \text{variant} \\ \text{system parameters} \end{bmatrix} \tag{5}$$

where the invariant part corresponds to the portion of the system parameters matrix which remains unchanged with respect to the design variables, and the variant part varies as a function of the design variables. Thus, the invariant part can be inverted and stored in order to avoid having to completely rerun the entire analysis for each iteration. Then, only the variant part needs to be repeatedly computed for each iteration, and the invariant part is recalled as needed. By storing the majority of system and modal information for use in subsequent iterations, the time typically needed to converge to a solution is approximately fifty times faster than when rerunning the complete analysis each time.

Figure 2:
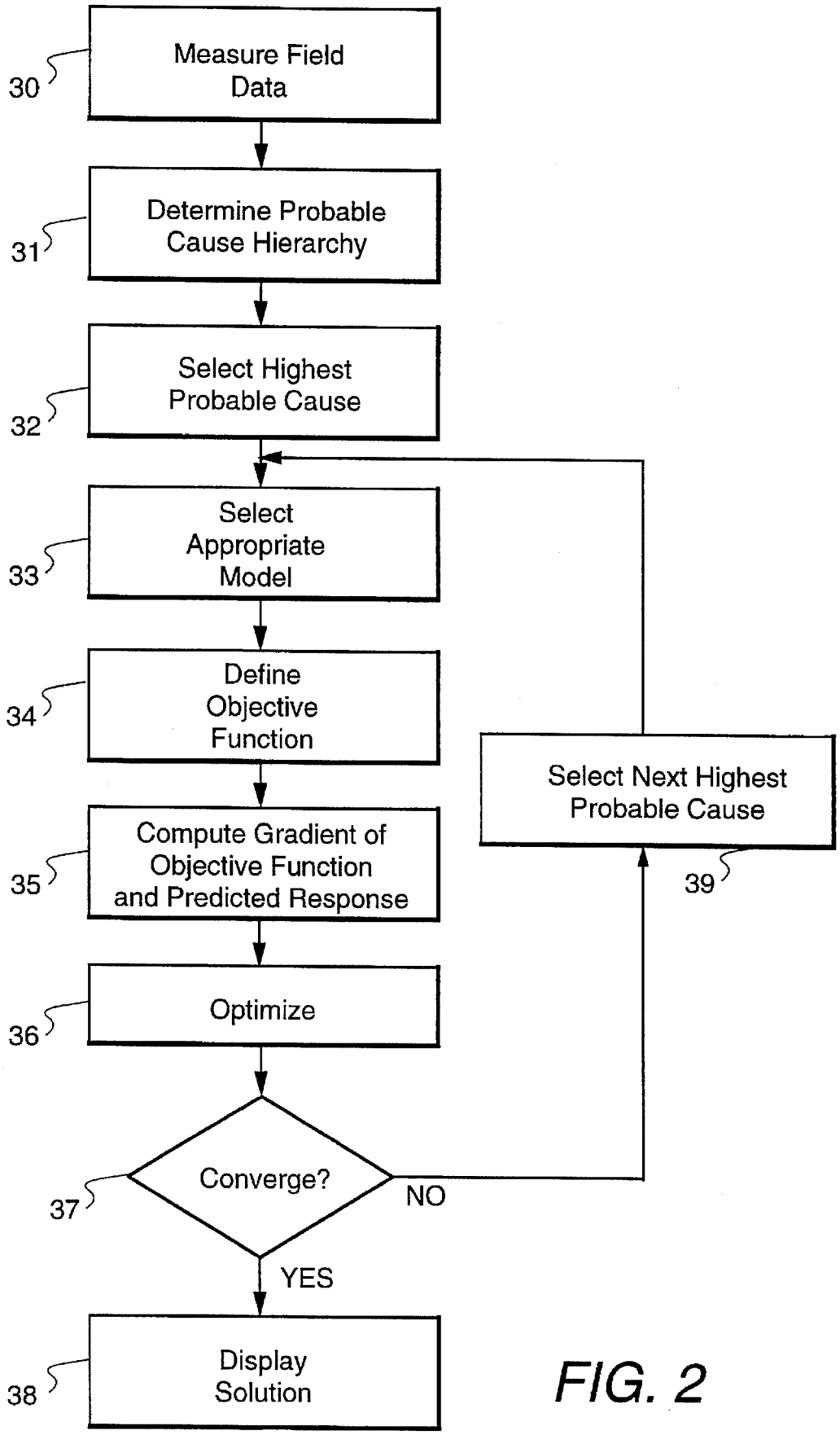
FIG. 2 is a flowchart describing the operation of the present invention.

Turning to FIG. 2, the operation of the present invention is described. The first step is to measure the field data or measured response from the machinery to be diagnosed as indicated by block 30. As mentioned above, a plurality of sensors 12 are provided to measure this data. Based on the measured response, the expert system 16 then determines a hierarchy of probable causes as indicated by block 31. The optimizer 18 selects the highest probable cause from the hierarchy as shown by block 32 and then selects the appropriate model from the library of analytical models 20 at block 33.

As indicated by block 34, an objective function is defined as the squares of the differences of the real and the imaginary parts of the measured and predicted responses. The gradient of the objective function with respect to the proper design variables and the selected model's predicted response are both computed as indicated by block 35. From these computations, as well as the measurement of the field data from block 30, the optimizer 18 carries out optimization as shown by block 36. The optimization process involves minimizing the objective function by repeatedly modifying the design variables which affect the probable cause selected in block 32. For example, if the highest probable cause identified by the expert system 16 was misalignment, then the design variable affecting alignment would be bearing elevation. The optimizer 18 would then modify the model parameters defining the bearing elevation. The direction and magnitude of these modifications would be controlled in part by the gradient of the objective function computed in block 35. The modifications to the bearing elevations in the analytical model would affect the weight of the rotor supported by the bearing, which in turn would affect the stiffness and damping properties of the bearing. These results would influence the dynamic behavior of the modelled machine, thus changing the model's predicted response.

The model is repeatedly modified in this fashion until the predicted response matches the measured response. In other words, optimization is continued until the predicted and measured responses converge so that their difference is, or is very close to, zero. As shown by block 37, if such convergence is reached, then a solution has been reached and is displayed at block 38. If on the other hand, the predicted and measured responses do not adequately converge, then the next highest probable cause from the hierarchy determined in block 31 is selected as indicated by block 39, and the process of blocks 33–39 is repeated until the desired convergence is achieved.

The foregoing has described an automated diagnostic system and method for rotating machinery. The system combines AI-based interpretive reasoning with rotordynamics modeling and numerical optimization, thereby producing the capacity to differentiate between various mechanical problems and to specify the severity of the problems.

While specific embodiments of the present invention have been described, it will be apparent to those skilled in the art that various modifications thereto can be made without departing from the spirit and scope of the invention as defined in the appended claims.

What is claimed is:

1. A method of diagnosing mechanical problems in rotating machinery, said method comprising the steps of:

measuring the actual response in the machinery to be diagnosed;

determining a probable cause of the mechanical problem based on the actual response;

selecting a model of the machinery based on the probable cause;

determining a predicted response from the model; and modifying the model so that the difference between the predicted response and the actual response is minimized, thereby identifying the mechanical problem.

2. The method of claim 1 wherein said step of determining a probable cause includes using interpretive-based reasoning.

3. The method of claim 1 wherein said step of selecting a model includes selecting a finite element model.

4. The method of claim 1 wherein said step of modifying the model includes defining an objective function as the squares of the differences of the real and the imaginary parts of the actual and predicted responses and minimizing the objective function.

5. The method of claim 4 wherein said step of modifying further includes computing the gradient of the objective function with respect to the model parameter which affects the probable cause.

6. The method of claim 1 wherein said step of modifying the model includes varying the model parameter which affects the probable cause.

7. The method of claim 1 further comprising the steps of:

determining a new probable cause of the mechanical problem based on the actual response when said step of modifying the model fails to minimize the difference between the predicted response and the actual response;

generating a new model of the machinery based on the new probable cause;

determining a new predicted response from the new model; and modifying the new model so that the difference between the new predicted response and the actual response is minimized, thereby identifying the mechanical problem.

8. A system for diagnosing mechanical problems in rotating machinery, said system comprising:

sensors for detecting the actual response of the machinery to be diagnosed;

a data processor for generating a signal of the actual response;

an expert system for determining a probable cause of the mechanical problem based on the actual response;

an analytical model of the machinery based on the probable cause; and an optimizer for comparing the actual response to a predicted response based on the model and modifying the model so that the difference between the predicted response and the actual response is minimized.

9. The system of claim 8 further comprising a plurality of analytical models based on a plurality of different potential probable causes.

* * * * *